US011378919B2

(12) United States Patent
Bonke

(10) Patent No.: US 11,378,919 B2
(45) Date of Patent: Jul. 5, 2022

(54) WATCH GLASS AND METHOD FOR PRODUCING A WATCH GLASS

(71) Applicant: REALIZATION DESAL AG, Oberwil (CH)

(72) Inventor: Michael Bonke, Oberwil (CH)

(73) Assignee: REALIZATION DESAL AG, Oberwil (CH)

( * ) Notice: Subject to any disclaimer, the term of this patent is extended or adjusted under 35 U.S.C. 154(b) by 586 days.

(21) Appl. No.: 16/348,048

(22) PCT Filed: Nov. 7, 2017

(86) PCT No.: PCT/EP2017/078423

§ 371 (c)(1),
(2) Date: May 7, 2019

(87) PCT Pub. No.: WO2018/091309

PCT Pub. Date: May 24, 2018

(65) Prior Publication Data

US 2019/0271951 A1 Sep. 5, 2019

(30) Foreign Application Priority Data

Nov. 21, 2016 (DE) ..... 10 2016 222 905.2

(51) Int. Cl.

| | |
|---|---|
| ***G04B 47/04*** | (2006.01) |
| ***G04B 39/00*** | (2006.01) |
| ***A44C 17/04*** | (2006.01) |

(52) U.S. Cl.

CPC ..... *G04B 47/042* (2013.01); *G04B 39/00* (2013.01); *A44C 17/04* (2013.01)

(58) Field of Classification Search

CPC ..... G04B 39/00; G04B 47/042; G04B 39/02; A44C 5/003; A44C 17/02

See application file for complete search history.

(56) References Cited

U.S. PATENT DOCUMENTS 4,473,306 A * 9/1984 Lederrey ..... G04B 47/042 368/285
5,119,350 A * 6/1992 Delacretaz ..... G04B 45/0007 368/223

(Continued)

FOREIGN PATENT DOCUMENTS

AT 502307 2/2007
AT 508838 10/2011

(Continued)

OTHER PUBLICATIONS

Intl. Search Report dated Jan. 8, 2018; PCT/EP2017/078423 filed Nov. 7, 2017. 3 pages.

(Continued)

*Primary Examiner* — Edwin A. Leon
*Assistant Examiner* — Jason M Collins
(74) *Attorney, Agent, or Firm* — Tucker Ellis LLP

(57) ABSTRACT

Provided is a watch glass including a support glass having at least one recess, a cover glass, at least one gemstone which is at least in part disposed in the recess, and a connecting intermediate layer by way of which the cover glass and the support glass are connected to one another. A region of an upper part of the gemstone is in direct contact with the intermediate layer.

15 Claims, 5 Drawing Sheets

(56) References Cited

U.S. PATENT DOCUMENTS

| | | | | |
|---|---|---|---|---|
| 5,400,304 | A * | 3/1995 | Ottenstein | G04B 19/106 368/281 |
| 9,820,538 | B2 * | 11/2017 | Lebreton | A44C 17/02 |
| 2011/0018132 | A1 | 1/2011 | Rey | |

FOREIGN PATENT DOCUMENTS

| | | | | |
|---|---|---|---|---|
| CH | 700244 | | 7/2010 | |
| DE | 2333186 | | 1/1974 | |
| DE | 8611077 | | 6/1986 | |
| DE | 102015204613 | | 9/2016 | |
| DE | 102015204622 | | 9/2016 | |
| EP | 0098240 | | 1/1984 | |
| EP | 1347349 | | 9/2003 | |
| FR | 2646759 | | 11/1990 | |
| GB | 2224632 | A * | 5/1990 | A44C 17/02 |

OTHER PUBLICATIONS

Search Report of the Basic Application—DE 102016222905.2; dated Jul. 12, 2017; 10 pages.

* cited by examiner

WATCH GLASS AND METHOD FOR PRODUCING A WATCH GLASS

RELATED APPLICATION DATA

This application is a National Phase Application of International Application No. PCT/EP2017/078423 filed Nov. 7, 2017, which claims benefit of German Application No. DE 10 2016 222 905.2 filed Nov. 21, 2016.

The invention relates to a watch glass having at least one gemstone, in particular a diamond, as well as to a method for producing a watch glass in which at least one gemstone is embedded. The present invention furthermore relates to a watch glass of this type.

Multi-layer watch glasses which have diamonds or other gemstones and which accommodate such stones in recesses of a support glass are known, wherein the support glass with the aid of an adhesive intermediate layer, for example an adhesive film, is adhesively bonded to a cover glass so as to form a type of laminated glass. The intermediate layer is not continuous but interrupted in the proximity of the gemstones, or at those locations of the recesses in which the gemstones are embedded, respectively, such that the intermediate layer is kept away from the gemstones. The reason therefore is to not compromise the optical properties, above all the "sparkle" of the gemstone, and the reflection of the light by the gemstone. Such a watch glass is disclosed in DE 10 2015 2046 13 A1, for example.

However, said watch glass, or the method for producing said watch glass, respectively, can in certain circumstances harbor disadvantages. It is thus aggravating that a round hole punched into an intermediate layer that is configured as a film does not expand uniformly in all directions when heated under pressure but has a "structural direction". This leads to an originally round hole being ultimately rendered oval. Moreover, it is possible that a recess in the intermediate layer that is configured as an adhesive film when laminated does not retain its original shape since the adhesive film becomes almost liquid in the heated lamination procedure. In the case of one of the usual thermal-laminating procedures using self-cross-linking lamination film it is therefore not at all possible for recesses in the lamination film to be placed effectively above the recesses in the support glass such that said recesses in the lamination film lead to the consequence that the gemstones are not acquired and wetted by the liquefying lamination compound. The method of recesses in the lamination film therefore drastically limits the bandwidth of the potential methods and materials. Said disadvantages are not present in a continuous lamination film.

By virtue of the adhesion forces between the cover glass and the gemstone, the gemstone by way of the table facet thereof often adheres to the lower side of the cover glass. This has the effect that so-called "Newton's rings" are formed at the location where the table facets contact the cover glass, on the one hand. This optical effect of Newton's rings is very disturbing and also interrupts the uniform appearance of a plurality of gemstones in the watch glass. On the other hand, those gemstones which adhere to the lower side of the watch glass sit somewhat higher than the "non-adherent" gemstones. A non-uniform appearance thus also results on account of the different height positions of the gemstones.

It is an object of the invention to propose a watch glass having at least one gemstone and a method for producing a watch glass having at least one gemstone, on account of which the disadvantages described above are alleviated. It is in particular an object of the invention to achieve a watch glass having at least one gemstone which has an improved optical appearance. It is furthermore an object of the invention to enable a method for producing a watch glass of this type.

The achievement of said objects is performed by the combination of features of the dependent claims.

The achievement is in particular performed by a watch glass which comprises a support glass having at least one recess; a cover glass; at least one gemstone; and a connecting intermediate layer. The gemstone is at least in part disposed in the recess. The cover glass and the support glass are connected to one another by way of the connecting intermediate layer. A region of an upper part of the gemstone is advantageously in direct contact with the intermediate layer. On account thereof, no air bubble which would hinder the light beams in advancing to the gemstone is created over the gemstone. To the observer, light is therefore not lost which causes an improved optical effect of the gemstone or of the watch glass, respectively. In the case of a watch glass having a multiplicity of gemstones it is furthermore avoided that some gemstones adhere to the lower side of the cover glass. The formation of "Newton's rings" is thus prevented on the one hand, and a uniform appearance by virtue of the identical height positions of all gemstones is achieved, on the other hand. The gemstone is preferably a diamond, a precious stone, a semi-precious stone, or a synthetic gemstone. The connecting intermediate layer can preferably be configured as an adhesive film, a lamination film, or a liquid adhesive which is cured in the assembled state. The intermediate layer is advantageously transparent. The region of the upper part of the gemstone comprises in particular a table of the gemstone. The upper part, or top part, respectively, of the gemstone is to be understood as that part that is situated above a girdle of the gemstone. The lower part, or the bottom part, respectively, of the gemstone is situated below the girdle of the gemstone. The girdle corresponds to an encircling edge between the top part and the bottom part in the case of cut gemstones, or to a separating periphery between the crown and the pavilion.

The achievement of the object described above is furthermore performed by a method for producing a watch glass in which a gemstone is embedded. The method comprises the steps of providing a support glass; providing a cover glass; incorporating at least one recess in the support glass; providing at least one gemstone; inserting the gemstone into the recess of the support glass; incorporating a connecting intermediate layer between the support glass and the cover glass; and placing the cover glass onto the support glass. The method advantageously furthermore comprises the step of connecting the cover glass to the support glass by way of the connecting intermediate layer in such a manner that a region of an upper part of the gemstone is in direct contact with the intermediate layer. The advantages described in the context of the watch glass are provided here too. Furthermore, the production method is facilitated when using an intermediate layer that is configured as a film, since no recesses have to be provided in the intermediate layer. The method is also simplified when using liquid adhesive, since the adhesive does not have to be kept away from the gemstone.

The dependent claims include advantageous refinements and aspects of the invention.

The upper part of the gemstone is preferably embedded in the intermediate layer. The upper part of the gemstone is thus in direct contact with the intermediate layer. Since no air exists about the upper part of the gemstone, no light is lost. The sparkle of the gemstone is thus increased.

The recess is preferably configured in such a manner that the recess and the gemstone at a contact region between the gemstone and the recess have complementary shapes. That is to say that an angle of the recess and an angle of the gemstone at the contact region between the gemstone and the recess are mutually adapted. A situation in which the gemstone closes the recess and thus prevents that the intermediate layer makes its way behind the gemstone or comes into contact with the lower part of the gemstone, in particular during a lamination procedure, thus results. The double reflection of the light in the lower part of the gemstone is ensured on account thereof.

According to one preferred design embodiment of the invention the upper part of the gemstone protrudes beyond the support glass. The gemstone is in particular disposed in the recess in such a manner that a girdle of the gemstone is situated above the plane of the support glass. It is thus enabled that the intermediate layer is kept away from the lower part of the gemstone.

A region of the recess below the contact region preferably has only a vacuum or air between the recess and the gemstone. The double reflection of the light in the bottom part of the gemstone is thus enabled. The gemstone thus has an optimal quota of reflected light and an optimal sparkle. The term "below the contact region" in the context of the invention, when said term is used in the context of a region, generally means that said region faces the bottom part of the gemstone.

A lamination film which is configured from ethylene vinyl acetate (EVA) is preferably used as the connecting intermediate layer. The lamination film is transparent and preferably has a refractive index of 1.48. The difference in the optical densities between the intermediate layer and the region of the top part of the gemstone that contacts the intermediate layer, in comparison to the difference between air and a region of the top part of the gemstone that is in contact with the air, is reduced because of the higher optical density of the lamination film in comparison with air. The total reflection angle at the interface between the intermediate layer and the top part is thus reduced when the lamination film bears on the top part of the gemstone. This results in less light being reflected in total at this location, that is to say that more light enters the stone, or exits the stone, respectively, at this location. The entering light is relayed to the bottom part of the gemstone and on the bottom part is reflected back to the top part. By virtue of the intermediate layer provided on the top part, the light can exit the gemstone without impediment at this location and without being reflected. More light can thus reach the observer.

A refractive index of the gemstone is furthermore preferably equal to a refractive index of the intermediate layer. On account thereof, the total reflection angle at the interface between the intermediate layer and the top part is entirely absent and the light exits the stone without impediment, that is to say that said light is not reflected back.

A further aspect of the invention relates to a watch which comprises an afore-described watch glass.

In order for the cover glass to be connected to the support glass, the intermediate layer is preferably heated in a linear manner to a final temperature. "Linear" means that the temperature curve runs in a consistent manner, that is to say that a gradient of the temperature curve is constant. The final temperature is in particular equal to 130° C. The heating to the final temperature of 130° C. preferably lasts 0.5 hours. The heating preferably commences at an initial temperature equal to a room temperature, wherein the room temperature is 20° C. The intermediate layer is thus preferably heated in a linear manner from the initial temperature of 20° C. to the final temperature of 130° C. within 0.5 hours.

According to one preferred embodiment of the invention, for connecting the cover glass to the support glass the intermediate layer in a first step is heated in a first temperature range between a first temperature and a second temperature for a first duration, and in a second step is heated in a second temperature range between a third temperature and a fourth temperature for a second duration. The third temperature herein is higher than or equal to the second temperature, and the fourth temperature is higher than the third temperature. On account of the intermediate layer being heated in the first temperature range, the cross-linking of the intermediate layer already takes place to a certain extent. As the cross-linking increases, the viscosity of the heated intermediate layer increases. This has the result that the cross-linking of the intermediate layer is completed by heating the intermediate layer in the second temperature range without the intermediate layer becoming truly liquid. The intermediate layer during the heating in the second temperature range remains in a gooey state. It is prevented on account thereof that the intermediate layer makes its way into the region of the recess below the contact region, between the recess and the gemstone.

The first duration is in particular 1 hour to 3 hours, and the second duration is in particular 0.3 hours to 1.0 hour.

The first temperature range is in particular 40° C. to 70° C., wherein the second temperature range is 70° C. to 140° C. The intermediate layer is thus heated to between 40° C. and 70° C. in the first step. The intermediate layer is heated to between 70° C. and 140° C. in the second step.

A temperature curve in which linear heating of the intermediate layer takes place can result in the case of this design embodiment of the invention by a chosen combination of the first temperature range and/or of the second temperature range, and/or of the first duration and/or of the second duration. As has already been described above, "linear" in the context of the invention means that a gradient of the temperature curve is constant.

In order for air bubbles to be removed, the entire assembly of the cover glass, the connecting intermediate layer, and the support glass, is preferably subjected to a vacuum in the lamination procedure. In the absence of this evacuation before and during the procedure of the cross-linking of the film, air bubbles would form overall in the laminate. The term "lamination procedure" refers to the connection procedure of the cover glass to the support glass by way of the connecting intermediate layer. The laminate is to be understood as being the entire assembly of the cover glass, the connecting intermediate layer, and the support glass in which the support glass and the cover glass are connected to one another by way of the connecting intermediate layer.

It is furthermore advantageous for additional pressure to be exerted on the two glasses during the cross-linking procedure. The lamination film adheres to the glasses more strongly, and the cross-linking contributes more positively toward said adhesion, on account thereof.

The space between the two glasses is expediently contemporaneously evacuated, and pressure from above is exerted on the assembly of the glasses and the connecting intermediate layer.

Further details, advantages, and features of the present invention are derived from the description hereunder of exemplary embodiments by means of the drawing, wherein identical parts, or functionally identical parts, respectively, are in each case identified by the same reference signs. In the drawing.

Figure 6A:
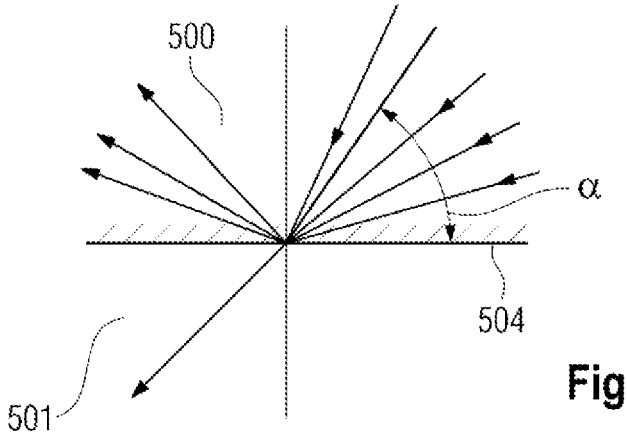
Figure 6B:
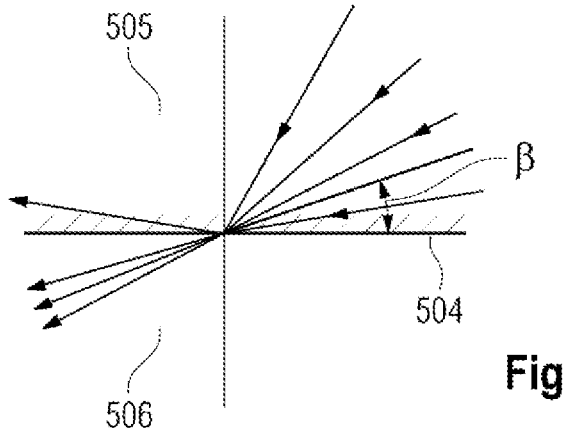
Figure 7:
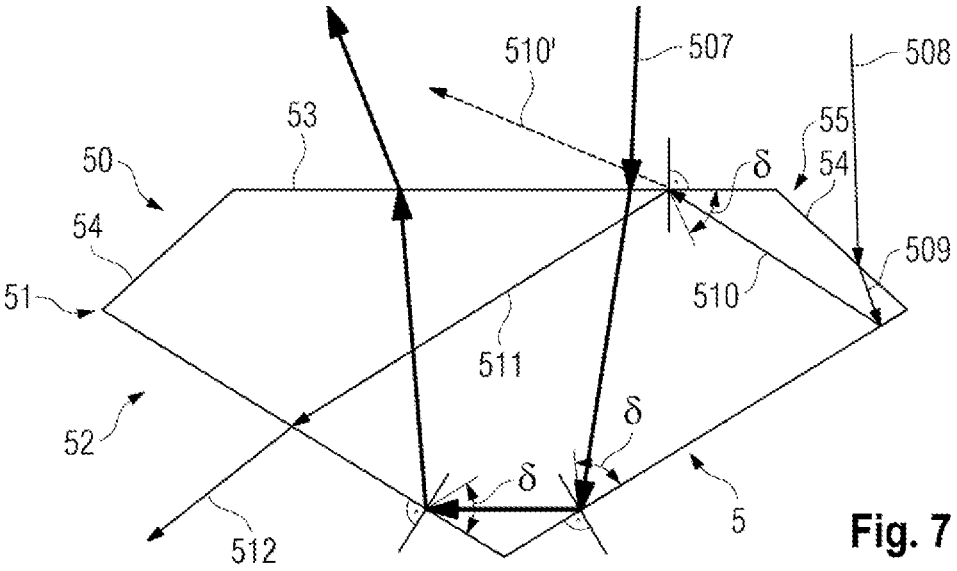
Figure 8:
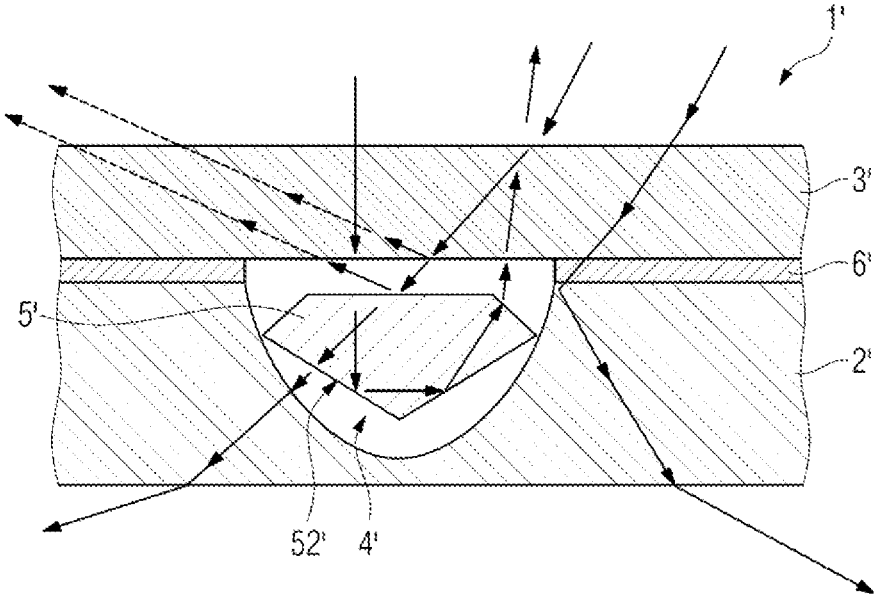
Fig. 8 (Prior Art)

FIGS. 6(*a*) and (*b*) show a second and a third diagrammatic illustration for explaining the phenomenon of total reflection;

FIG. 7 shows a view of a gemstone having light beams plotted therein, for explaining the advantages of the present invention; and FIG. 8 shows a schematic simplified view of a watch glass having an embedded gemstone, according to the prior art.

A watch glass 1 according to a first exemplary embodiment of the present invention will be described in detail hereunder with reference to FIGS. 1 and 2.

Figure 1:
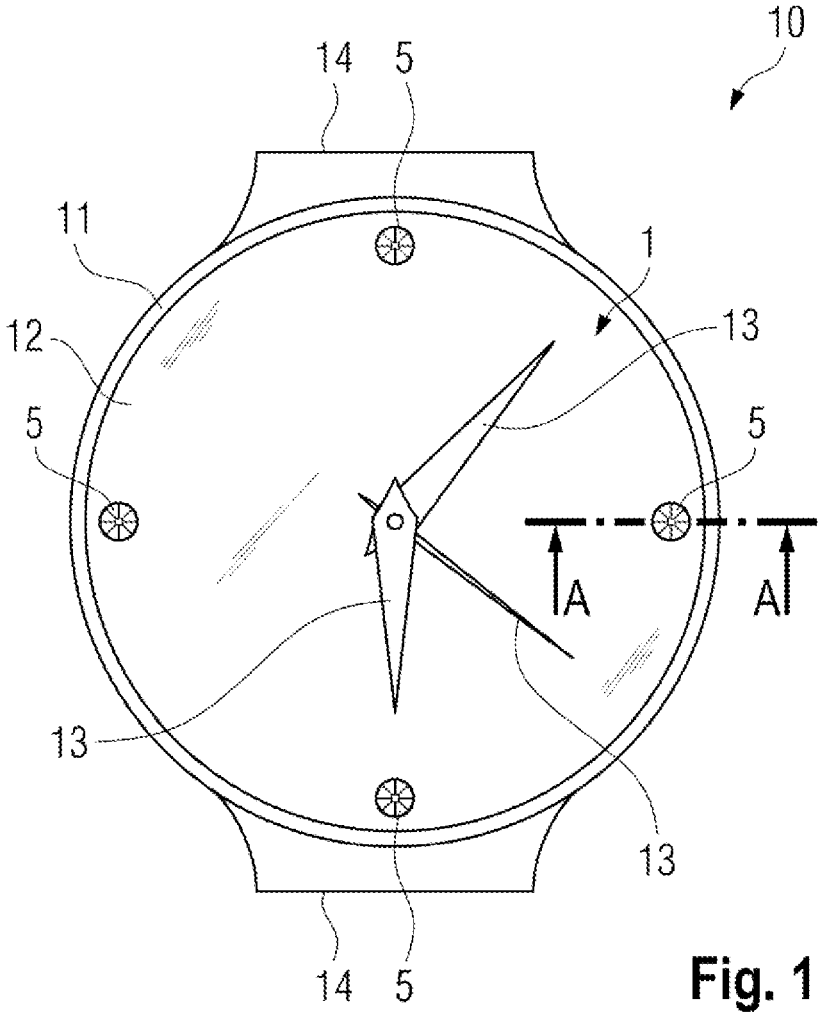
FIG. 1 shows a plan view of a watch which comprises a watch glass having diamonds.

FIG. 1 shows a watch 10 in the form of a wristwatch having a housing 11 and a watch glass 1 according to the invention, the latter being disposed in the housing 11 and provided with gemstones 5, in particular diamonds. The housing 11 as well as the watch glass 1 are configured so as to be circular but can have any other shape such as, for example, that of a rectangle, a polygon, etc. In particular, four gemstones 5 that are illustrated as diamonds herein are disposed at a constant radius and at mutually identical spacings in the circumferential direction in the watch glass 1. The position as well as the number of gemstones 5 can however be chosen in an arbitrary manner, depending on the design of the watch. It is thus likewise possible for one gemstone, two or twelve gemstones, to be installed in the watch glass 1, for example. The watch 10 furthermore has a watch dial 12 which is configured, for example, as a gold dial, as well as three-pointers 13 for indicating the hours, minutes, and seconds, and two connectors for a wrist strap 14.

Figure 2:
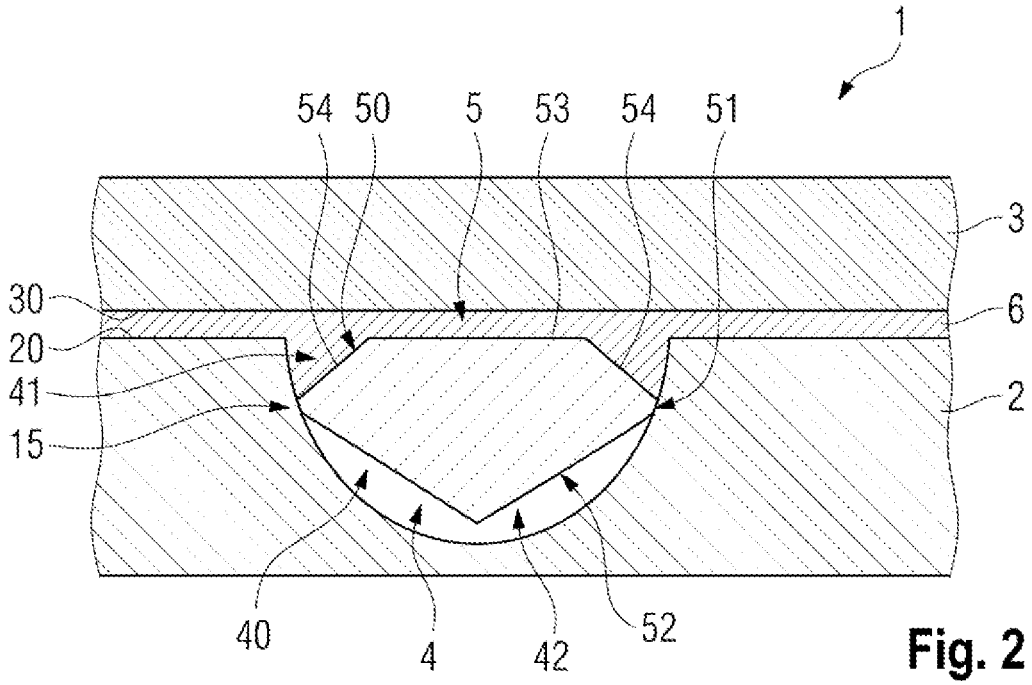
FIG. 2 shows a simplified schematic sectional view of a region of a watch glass according to a first exemplary embodiment of the present invention.

FIG. 2 shows a simplified, schematic view of a section A-A of the watch glass 1 of FIG. 1. The watch glass 1 has a support glass 2 and a cover glass 3. The support glass 2 and the cover glass 3 are preferably configured from different types of glass, in particular from mineral glass for the support glass, and from sapphire glass as the cover glass. Other glass types can also be used. In the context of the invention it is possible for different or identical types of glass to be combined.

Recesses 4 which serve for receiving gemstones 5 are configured in the support glass 2. One recess 4 can be seen in FIG. 2. The gemstone 5 is preferably completely disposed in the recess 4. The cover glass 3 and the support glass 5 are in particular configured so as to be circular and have identical diameters. The glasses 2, 3 differ from one another in terms of the thickness thereof, wherein the cover glass 3 is preferably formed so as to be thinner. However, it is also possible for the two glasses 2, 3 to have identical thicknesses. Furthermore, an internal face 20 of the support glass 2 and an internal face 30 of the cover glass 3 at the contact location of the two glasses 2, 3 are configured so as to be flat. According to an alternative design embodiment, however, the internal faces 20, 30 can also be curved in an identical and complimentary manner.

The cover glass 3 and the support glass 2 are connected to one another by way of a connecting intermediate layer 6. The intermediate layer 6 can in particular be configured as an adhesive film, a lamination film, an adhesive, or another connecting compound. The intermediate layer 6 is disposed between the cover glass 3 and the support glass 2. A seamless, air-tight connection thus results between the watch glass 3 and the support glass.

An upper part 50 of the gemstone 5 is advantageously embedded in the intermediate layer 6. The upper part 50 of the gemstone 5 preferably comprises a table 53 and upper facets 54 of the gemstone 5. The table 53 corresponds to a region of the upper part 50 of the gemstone 5.

The upper part 50 of the gemstone 5 is thus in direct contact with the intermediate layer 6.

The recess 4 and the gemstone 5 at a contact region 15 between the gemstone 5 and the recess 4 preferably have complimentary shapes. In this exemplary embodiment, the contact region 15 corresponds to a girdle 51 of the gemstone 5. The girdle 51 separates the upper part 50 from a lower part 52 of the gemstone 5.

A lower region 40 of the recess 4 below the contact region 15 has only a vacuum or air. An upper region 41 of the recess 4, on the other side, is advantageously filled with material of the intermediate layer 6. The lower region 40 of the recess 4 corresponds to a region 42 of the recess 4 below the contact region 15.

An overall improved optical appearance of the watch glass 1 is achieved on account of this design embodiment of the watch glass 1. One reason therefore is that the upper part 50 of the gemstone 5 is not situated in an air bubble. That is to say that the top part 50 of the gemstone is not surrounded by air. Fewer reflections thus arise on the surface of the gemstone, and the incident light on the gemstone can enter the gemstone without impediment. Furthermore, the refractive index and thus also the total reflection angles are reduced by the intermediate layer (lamination compound) which bears on the top part and which also represents an optical medium. This facilitates the unimpeded exit of light at the top part 50, this being important for the sparkle of the gemstone. On the other hand, the air that is situated in the lower region 40 of the recess 4, or the vacuum that is situated there, respectively, leads to the light in the lower part 52 of the gemstone 5 being totally reflected twice at the interface between the gemstone 5 and the air. This is possible because air, or the vacuum, respectively, has a much lower optical density than the gemstone 5. The total reflection angle which indicates within which angle a reflection of the light by one hundred percent arises is high because of the large difference between the optical density of the air/vacuum and the gemstone 5. This means that the intensity of the shine or the sparkle of the gemstone 5 is also high in the case of a high total reflection angle.

In other words, in the case of a watch glass having a gemstone according to the invention, wherein the top part of the gemstone is at least in part in contact with the intermediate layer, the top part attracts much light and transmits said light to the bottom part.

When the bottom part is situated in air or a vacuum, the light transmitted by the top part is advantageously reflected back to the top part. The light, by way of the top part, can thus exit the gemstone and make its way to the eye of an observer.

A small total reflection angle is achieved by way of the targeted contact between at least a region of the top part of the gemstone and the intermediate layer. The small total reflection angle in the case of the top part has the effect that a certain part of the light which emanates obliquely from the bottom part, can exit the top part and is not sent back into the bottom part.

A high total reflection angle results on account of a contemporaneous contact between the bottom part and air, or when the bottom part is situated in a vacuum. Little or no light thus leaves the gemstone by way of the bottom part of the latter.

In order for the cover glass 3 to be connected to the support glass 2, the intermediate layer 6 is preferably heated in a linear manner from an initial temperature of 20° C. to a final temperature of 130° C. within 0.5 hours.

Alternatively, for connecting the cover glass 3 to the support glass the intermediate layer 6 can be heated in a first step and in a second step. The intermediate layer 6 in the first step is in particular heated in a first temperature range between a first temperature T1 and a second temperature T2 for a first duration t1.

The intermediate layer 6 in the second step is subsequently heated in a second temperature range between a third temperature T3 and a fourth temperature T4 for a second duration t2.

The third temperature T3 herein is higher than or equal to the second temperature T2, and the fourth temperature T4 is higher than the third temperature T3.

The first temperature range preferably is 40° C. to 70° C., and the second temperature range is 70° C. to 140° C. In this case, the first temperature T1 is then equal to 40° C., the second temperature T2 is equal to 70° C., the third temperature T3 is equal to 70° C., and the fourth temperature T4 is equal to 140° C. The first duration t1 is preferably 3 hours, and the second duration t2 is 0.5 hours.

The viscosity of the intermediate layer 6 in the first temperature range is increased by virtue of the cross-linking of the intermediate layer 6 that takes place. This leads to the intermediate layer 6 in the subsequent heating thereof in the second temperature range not becoming truly liquid as compared to single-stage heating.

In the case of the intermediate layer 6 being heated in two steps it is thus ensured that the intermediate layer 6 does not make its way into the region below the contact region 15, between the recess 4 and the gemstone 5, or into the lower region 40 of the recess 4, respectively.

Figure 3:
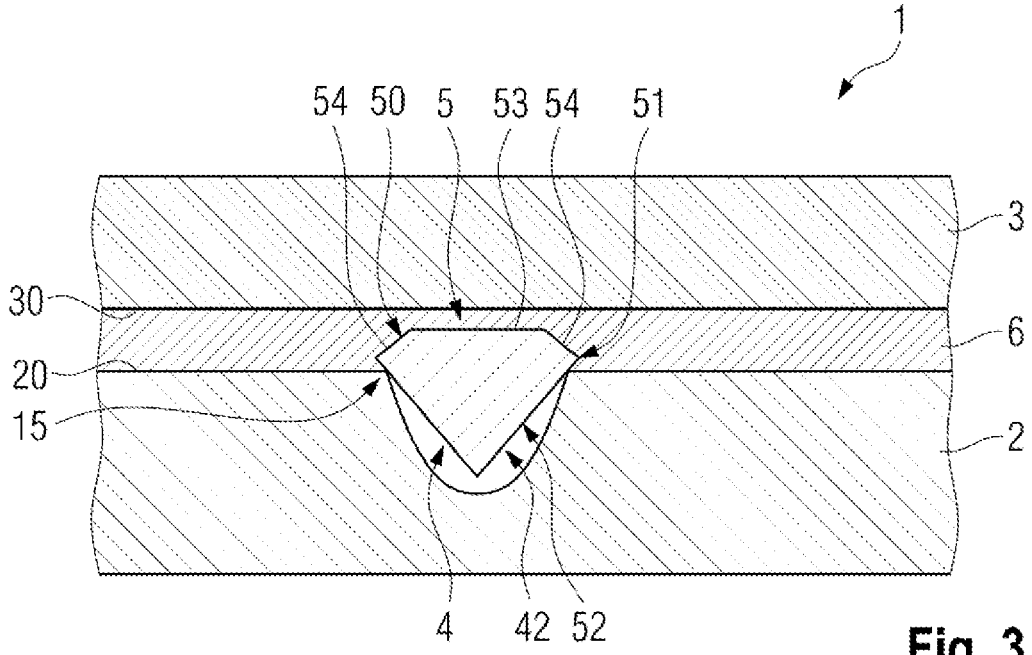
FIG. 3 shows a simplified schematic sectional view of a region of a watch glass according to a second exemplary embodiment of the present invention.

FIG. 3 shows a watch glass 1 according to a second embodiment of the invention.

In this exemplary embodiment, the gemstone 5 is disposed in the recess 4 in such a manner that the upper part 50 of the gemstone 5 projects beyond the plane of the support glass 2. The girdle 51 of the gemstone 5 is thus situated above the plane of the support glass 2 and is embedded in the intermediate layer 6. The contact between the gemstone 5 and the recess 4 thus takes place in the lower region 52 of the gemstone 5.

This disposal of the gemstone 5 in the recess 4 offers a further measure by way of which the penetration of the intermediate layer 6 into the region 42 of the recess 4 below the contact region 15 between the recess 4 and the gemstone 5 is prevented. The recess 4 and the gemstone 5 at the contact region 15 can furthermore preferably have complimentary shapes. This can be performed, for example, by chamfering the recess 4. The region 42 of the recess 4 below the contact region 15 in this exemplary embodiment corresponds to the complete recess 4.

Apart from the written description of the invention above, reference herewith for the purpose of an additional disclosure of said invention is explicitly made to the illustration of the invention in terms of the drawings in FIGS. 1 to 3.

Figure 4:
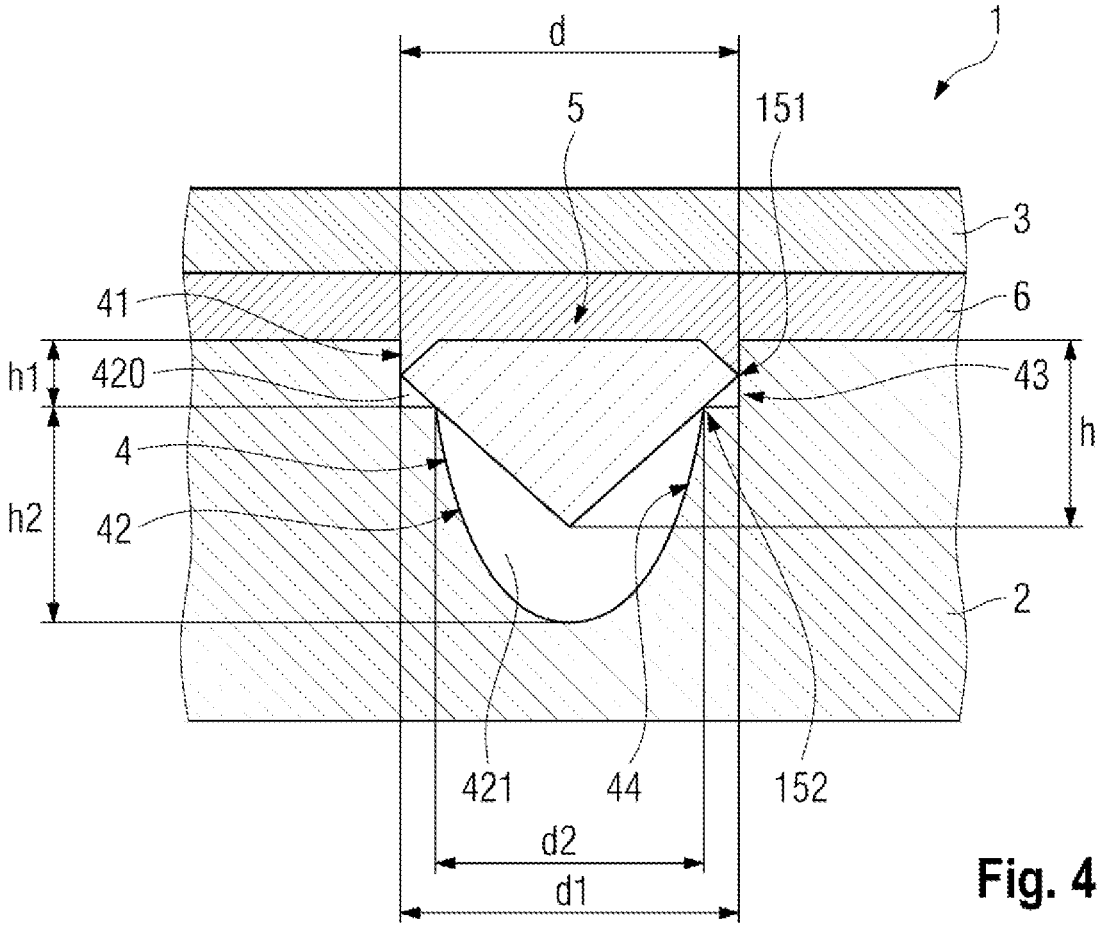
FIG. 4 shows a simplified schematic sectional view of a region of a watch glass according to a third exemplary embodiment of the present invention.

FIG. 4 shows a watch glass 1 according to a third exemplary embodiment of the invention.

In this exemplary embodiment the recess 4 of the support glass 2 is configured as a stepped recess. The stepped recess 4 has a first step 43 and the second step 44.

As can be seen from FIG. 4, the gemstone 5 has a gemstone height h and a gemstone diameter d.

The first step 43 furthermore has a first height h1 and a first diameter d1, and the second step 44 has a second height h2 and a second diameter d2. The first height h1 of the first step 43 is preferably approx. a quarter of the gemstone height h. The second height h2 is preferably at least equal to or larger than the height of the gemstone height h.

The first diameter d1 is preferably essentially equal to the gemstone diameter d, wherein the second diameter d2 is preferably smaller than the gemstone diameter d by 10%.

The gemstone 5 is disposed in the recess 4 in such a manner that gemstone 5 is in contact with the recess 4 at two locations. The contact region 15 between the recess 4 and the gemstone 5 thus comprises a first contact part-region 151 and a second contact part-region 152.

The first contact part-region 151 is preferably created on account of the contact of the girdle 51 of the gemstone 5 with the first step 43 of the recess 4. The second contact part-region 152 preferably results on account of the contact of the bottom part 52 of the gemstone 5 with the second step 44 of the recess 4.

The first contact part-region 151 and the second contact part-region 152 serve as a double barrier which prevents the gemstone 5 being invaded from behind by the intermediate layer 6.

The region 42 of the recess 4 below the contact region 15 thus comprises a first part-region 420 and a second part-region 421. In particular, the first part-region 420 below the first contact part-region 151 extends up to the second contact part-region 152. The second part-region 421 is provided below the second contact part-region 152.

Air or a vacuum is provided in the first part-region 420 and/or in the second part-region 421.

It is furthermore possible for the recess 4 and the gemstone 5 to have complimentary shapes at the first contact region 151 and/or the second contact region 152.

As in the preceding exemplary embodiments, the top part 50 of the gemstone 5 is in direct contact with the intermediate layer 6.

Figure 5:
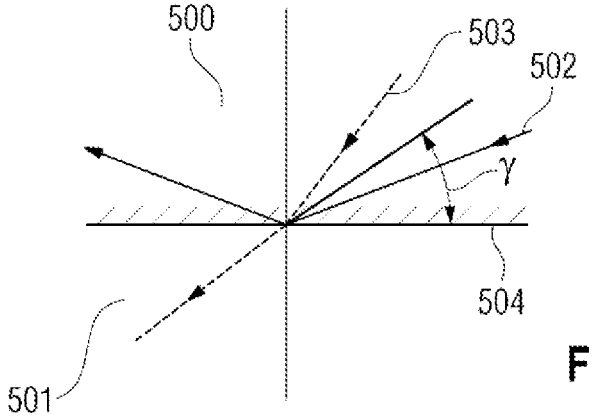
FIG. 5 shows a first diagrammatic illustration for explaining the phenomenon of total reflection.

FIG. 5 represents a first diagrammatic illustration for explaining the phenomenon of total reflection.

A first optical medium 500 and a second optical medium 501 are shown in FIG. 5. The first optical medium 500 is optically denser as compared to the second optical medium 501. "Optically denser" means that the first optical medium 500 has a higher refractive index than the second optical medium 501. The refractive index, or the optical density, of a medium is an optical material property of the medium. This dimensionless physical variable indicates by way of which factor the wavelength and the phase velocity of light are reduced as compared to in a vacuum. Light is generally refracted and reflected at the interface between two optical media of dissimilar optical densities, or dissimilar refractive indices, respectively.

The higher the difference in the optical densities between two optical media, the higher the so-called total reflection angle. The total reflection angle indicates the angle within which a reflection of the light by one hundred percent, thus without any loss of light, arises.

It is to be noted that a vacuum (or air) has the refractive index 1. Diamond has the refractive index 2.51. This is the highest refractive index which exists in optics. The size of the total reflection angle in the case of a refractive index of 2.51 is approx. 65°, this being the largest total reflection angle which exists in optics.

The total reflection angle in FIG. 5 is provided with the reference sign γ. A first light beam 502 is totally reflected because the light is incident on an interface 504 between the first optical medium 500 and the second optical medium 501 within the total reflection angle γ. On the other side, part of a second light beam 503 (plotted with a dashed line), which is incident on the interface 504 outside the total reflection angle γ, enters the second optical medium 501, or said part of the light exits the first optical medium 500, respectively. Part of the light of the second light beam 502 is thus lost.

FIGS. 6 (*a*) and 6 (*b*) show a second and a third diagrammatic illustration for explaining the phenomenon of total reflection.

The effect of the size of the total reflection angle on the incident light on an interface between two optical media becomes particularly evident from FIGS. 6 (*a*) and (*b*).

A first optical medium 500 and a second optical medium 501 are shown in FIG. 6 (*a*). The first optical medium 500 is optically denser as compared to the second optical medium 501. A first total reflection angle is provided with the reference sign α. Since the difference between the optical densities of the first optical medium 500 and the second optical medium 501 is comparatively high, the first total reflection angle α is also relatively high. A large proportion of the light beams which are incident on the interface 504 is thus situated within the first total reflection angle α and is thus totally reflected.

A third optical medium 505 and a fourth optical medium 506 are shown in FIG. 6 (*b*). The third optical medium 505 is optically denser as compared to the fourth optical medium 506. A second total reflection angle is provided with the reference sign β. The difference between the optical densities of the third optical medium of 505 and of the fourth optical medium 506 is smaller than the difference between the optical densities of the first optical medium 500 and the second optical medium 501. The second total reflection angle β is thus smaller than the first total reflection angle α. This means that a smaller proportion of the light beams which are incident on the interface 504 in FIG. 6 (*b*) is totally reflected, as compared to FIG. 6 (*a*).

Advantages of the present invention will be explained by means of FIG. 7.

A light beam 507 (plotted with a solid line) incident on the table 53 of a gemstone 5 that is situated in air, by virtue of the high gemstone total reflection angle δ, is is typically totally reflected twice on the faces of the bottom part 52 and exits the gemstone 5 again by way of the table 53. However, a light beam 508 incident on a periphery 55 of the gemstone 5, because of a total reflection on the table 53, or the internal side of the table 53, respectively, (light beams 510 and 511), can no longer reach the observer by way of the table 53. More specifically, the light beam 508 enters the gemstone 5 by way of the periphery 55 (light beam 509) and is totally reflected on a face of the bottom part 52 (light beam 510). The light beam 510, by virtue of the high gemstone total reflection angle δ, is totally reflected on the internal side of the table 53 and then exits the gemstone 5 by way of the bottom part 52 (light beams 511 and 512), that is to say that said light beam 510 is lost to the observer. The periphery 55 comprises the top-part facets 54 of the gemstone 5.

On the other side, by virtue of the direct contact of a region of the top part 50 of the gemstone 5, in particular of the table 53 in FIG. 7, with the intermediate layer 6, the total reflection of the light beam 510 in the case of the present invention is avoided on the internal side of the table 53. Part of the light beam 510 as the light beam 510' (plotted with dashed lines) can thus reach the observer by way of the table 53. This means that the gemstone 5 thus sparkles more intensely or shines more intensively.

FIG. 8 shows a watch glass 1' from the prior art, in which a gemstone 5' is situated in a recess 4' with air. An intermediate layer 6' connects a support glass 2' to a watch glass 3', wherein the intermediate layer 6' is not continuous, that is to say that the intermediate layer 6' comprises a recess above the recess 4'. With a view also to the description of FIGS. 5 7, it can be seen that light is lost to the observer at a plurality of locations in the case of this watch glass 1', for example at an interface between the cover glass 3' and the air situated in the recess 4', or an interface between the bottom part 52' of the gemstone 5' and the air situated in the recess 4', because of the angle of the incident light on the bottom part 52'. This angle is determined by the air between the gemstone 5' and the cover glass 2'.

LIST OF REFERENCE SIGNS

1, 1' Watch glass
2, 2' Support glass
3, 3' Cover glass
4, 4' Recess
5, 5' Gemstone/diamond/precious stone/synthetic gemstone
6, 6' Intermediate layer
10 Watch
11 Housing
12 Watch dial
13 Pointer
14 Connector for a wrist strap
15 Contact region between the recess and the gemstone
20 Internal side of the support glass (side of the support glass that faces the cover glass)
30 Internal side of the cover glass (side of the cover glass that faces the support glass)
40 Lower region of the recess
41 Upper region of the recess
42 Region below the contact region
43 First step of the recess
44 Second step of the recess
50 Upper part (top part) of the gemstone
51 Girdle (central part) of the gemstone
52, 52' Lower part (bottom part) of the gemstone
53 Table of the gemstone
54 Upper facets of the gemstone
55 Periphery of the gemstone
151 First contact part-region
152 Second contact part-region
420 First part-region of the lower region of the recess
421 Second part-region of the lower region of the recess
500 First optical medium
501 Second optical medium
502 First light beam
503 Second light beam
504 Interface
505 Third optical medium
506 Fourth optical medium
507 to 512 Light beams
510' Light beam
A-A Section
d Diameter of the gemstone/Gemstone diameter
h Height of the gemstone/Gemstone height
d1 First diameter d2 Second diameter
h1 First height
h2 Second height
α First total reflection angle
β Second total reflection angle
γ Total reflection angle
δ Gemstone total reflection angle

The invention claimed is:

1. A watch glass comprising:
a support glass having at least one recess;
a cover glass;
at least one gemstone that is at least in part disposed in the recess; and
a connecting intermediate layer by way of which the cover glass and the support glass are connected to one another,
wherein a region of an upper part of the gemstone is in direct contact with the intermediate layer, and
wherein a region of the recess below a contact region between the gemstone and the recess has only air or a vacuum between the recess and the gemstone.

2. The watch glass as claimed in claim 1, wherein the upper part of the gemstone is embedded in the intermediate layer.

3. The watch glass as claimed in claim 2, wherein the recess is formed in such a manner that the recess and the gemstone at the contact region have complementary shapes.

4. The watch glass as claimed in claim 2, wherein the upper part of the gemstone protrudes beyond the support glass.

5. The watch glass as claimed in claim 1, wherein the recess is formed in such a manner that the recess and the gemstone at the contact region have complementary shapes.

6. The watch glass as claimed in claim 5, wherein the upper part of the gemstone protrudes beyond the support glass.

7. The watch glass as claimed in claim 1, wherein the upper part of the gemstone protrudes beyond the support glass.

8. A watch comprising a watch glass as claimed in claim 1.

9. A method for producing a watch glass in which at least one gemstone is embedded, said method comprising the steps of:
providing a support glass;
providing a cover glass;
incorporating at least one recess in the support glass;
providing at least one gemstone;
inserting the gemstone into the recess of the support glass, wherein a region of the at least one recess below a contact region between the at least one gemstone and the at least one recess has only air or a vacuum between the at least one recess and the at least one gemstone;
incorporating a connecting intermediate layer between the support glass and the cover glass;
placing the cover glass onto the support glass; and
connecting the cover glass to the support glass by way of the connecting intermediate layer in such a manner that a region of an upper part of the gemstone is in direct contact with the intermediate layer.

10. The method as claimed in claim 9, wherein for connecting the cover glass to the support glass the intermediate layer in a first step is heated in a first temperature range between a first temperature T1 and a second temperature T2 for a first duration t1, and in a second step is heated in a second temperature range between a third temperature T3 and a fourth temperature T4 for a second duration t2, wherein the third temperature T3 is higher than or equal to the second temperature T2, and the fourth temperature T4 is higher than the third temperature T3.

11. The method as claimed in claim 10, wherein the first temperature range is 40° C. to 70° C., and the second temperature range is 70° C. to 140° C.

12. The method as claimed in claim 11, wherein the intermediate layer is heated in a linear manner to a final temperature equal to 130° C.

13. The method as claimed in claim 10, wherein the intermediate layer is heated in a linear manner to a final temperature equal to 130° C.

14. The method as claimed in claim 9, wherein the intermediate layer is heated in a linear manner to a final temperature equal to 130° C.

15. A method for producing a watch glass in which at least one gemstone is embedded, said method comprising the steps of:
providing a support glass;
providing a cover glass;
incorporating at least one recess in the support glass;
providing at least one gemstone;
inserting the gemstone into the recess of the support glass;
incorporating a connecting intermediate layer between the support glass and the cover glass;
placing the cover glass onto the support glass; and
connecting the cover glass to the support glass by way of the connecting intermediate layer in such a manner that a region of an upper part of the gemstone is in direct contact with the intermediate layer,
wherein for connecting the cover glass to the support glass the intermediate layer in a first step is heated in a first temperature range between a first temperature T1 and a second temperature T2 for a first duration t1, and in a second step is heated in a second temperature range between a third temperature T3 and a fourth temperature T4 for a second duration t2, wherein the third temperature T3 is higher than or equal to the second temperature T2, and the fourth temperature T4 is higher than the third temperature T3.

* * * * *